US007448420B2

(12) United States Patent
Mair

(10) Patent No.: US 7,448,420 B2
(45) Date of Patent: Nov. 11, 2008

(54) OFFSET ROUTER FLUSH CUTTING BASE

(76) Inventor: John F. Mair, 60 Suite D, Liberty Ship Way, Sausalito, CA (US) 94965

( * ) Notice: Subject to any disclaimer, the term of this patent is extended or adjusted under 35 U.S.C. 154(b) by 41 days.

(21) Appl. No.: 11/698,552

(22) Filed: Jan. 26, 2007

(65) Prior Publication Data

US 2007/0131304 A1 Jun. 14, 2007

Related U.S. Application Data

(63) Continuation of application No. 10/750,918, filed on Dec. 31, 2003, now abandoned.

(51) Int. Cl.
*B27C 5/00* (2006.01)

(52) U.S. Cl. ..... 144/136.95; 409/182

(58) Field of Classification Search ..... 144/136.95, 144/154.5, 48.5, 144.1; 409/180–182
See application file for complete search history.

(56) References Cited

U.S. PATENT DOCUMENTS 1,574,740 A * 2/1926 Raynor ..... 30/477
3,454,061 A * 7/1969 Okoniewski et al. ..... 144/134.1
3,494,395 A * 2/1970 Graham ..... 144/136.95
4,132,254 A * 1/1979 Shockovsky ..... 144/154.5
4,461,330 A * 7/1984 Judkins ..... 144/154.5
4,551,047 A * 11/1985 Price ..... 409/182
4,827,996 A * 5/1989 Cotton et al. ..... 144/154.5
5,013,196 A * 5/1991 Friegang ..... 409/182
6,068,036 A * 5/2000 Cassidy ..... 144/134.1
6,148,880 A * 11/2000 Dehde et al. ..... 144/118
6,846,138 B1 * 1/2005 Phillips et al. ..... 409/182

* cited by examiner

*Primary Examiner*—Shelley Self
(74) *Attorney, Agent, or Firm*—Thomas W. Cook

(57) ABSTRACT

A router sub-base and method is disclosed, utilizing a pad of material attached to a router base, to flush cut projections from a wooden surface, smooth areas of a wooden surface, or remove a volume of wood to custom shape a wooden workpiece for special applications, in which a user may manually operate the router to mill wood, using a portion of the existing wooden workpiece surface as a guide to control cutting.

4 Claims, 3 Drawing Sheets

OFFSET ROUTER FLUSH CUTTING BASE

CROSS REFERENCE TO RELATED APPLICATIONS

This application is a continuation of application Ser. No. 10/750,918, filed Dec. 31, 2003 from which the applicant claims priority now abandoned.

TECHNICAL FIELD OF THE INVENTION

The present invention relates to "flush cutting," or "milling" using a guide attached to a router. More specifically, the present invention is a router base; which is manually operated by a user as a guide when attached to an offset router, to mill wood, using a portion of the existing wooden workpiece surface to control the guide. With the present invention, a user may "flush cut" projections from a wooden surface, finish (smooth) areas of a wooden surface, or remove a volume of wood to custom shape a wooden workpiece for special applications.

BACKGROUND ART OF THE INVENTION

Removing projections or imperfections from a wooden surface is a common task when working with wood. For instance, in assembling wooden boat decking, holes are drilled in the decking material to create wells which will accept wooden plugs. Decking screws are then typically counter-sunk at the bottom of such wells, and the wooden plugs are then driven into the wells, and glued in place, to seal the screws underneath from moisture and weather. The top ends of the wooden plugs, along with residual glue, projecting above the level of the top surface of the deck so constructed, remain to be removed after the plugs are driven into the wells. Removal of the ends of the plugs and residual glue as they project above the planks of the deck is necessary to achieve the smooth surface required for finished decking.

Other tasks when working with wood are difficult to achieve without special tools. One such task is the creation of a custom piece, such a wooden threshold. When such a piece must be wider than standard sizes, shaping a threshold to fit a required shape using hand or power tools found in most woodworking shops is difficult and time consuming, and the resulting custom piece often uneven and unacceptable. Other tasks easily accomplished using the present invention include removing excess dried glue at the joinder of two pieces of wood, and planing a surface to smooth it where the wood grain has been raised by water or weathering.

Currently there is no simple tool or process to perform some of these woodworking tasks. Where a tool is available to perform some part of these tasks, the tool often is not suitable to complete the entire task, or it is expensive, or using the tool is time consuming or difficult. Wood workers have therefore found it necessary to use a variety of tools, or apply exceptional skill, to accomplish even simple tasks. To take only one example, boat makers fabricating wooden boat decks have up until now sawed off the tops plugs inserted in decks by hand, or chiseled them off, a laborious and time consuming job, and then planed or sanded the surface of the deck to achieve a smooth surface. Even when such methods are used, however, these tools are not optimal to achieve a smooth surface, as a saw, chisel, or plane may each mar the surface of the deck, or take too much of the plug as it splits with its grain. Using both a saw or chisel in conjunction with a plane or sand paper also requires time for each operation or application of a tool, thereby increasing labor costs. To take another example, contractors and wood workers often must fabricate custom pieces to fit a job requiring cutting for unusual dimensions using standard-sized wood stock, or fabricate suitable pieces from combinations of pre-existing standard-sized wood stock, or order a custom piece. As a result, either much time is spent custom fabricating such pieces (if the pieces may be fabricated at all in this way), or the cost of an installation is large, when projects involve unusual dimensions are encountered (such as thresholds).

Apparatus and methods for working a wooden surface, including saws, routers, planes, and similar tools, are common in the related art. Routers, for instance, are used to remove material from surfaces for decorative and functional purposes. Routers typically have a base, and a motor disposed in a housing. The motor drives a rotatable shaft which extends downward beyond the lower end of the housing and base when the router is sitting flat on a surface, with the shaft adapted to secure a router bit thereto. The router bit extends through a central opening in the base to cut a workpiece. Existing routers, because of their relatively small size and rotary cutting action, come perhaps closest to providing the kind of facility and flexibility necessary to overcome the difficulties set forth above. However, existing routers, because of the way the router bit is oriented toward the workpiece, are not set up for, or adaptable to, removal of irregularities in a wooden surface, or cutting portions of a larger piece to modify its shape to create a threshold, or other custom piece.

Existing standard routers use a cast base, typically formed of aluminum and having one side, the underside or bottom side, machined to create a planer guide face through which the shaft and bit protrude. When cutting (the edge of) a workpiece, a user slides the bottom of the router base across the workpiece along its edge. Generally, a second guide, often a bearing attached to the end of the bit, but sometimes some other form of "edgeguide" which may be clamped to the workpiece, is used to assure a smooth cut along the edge of the workpiece. The cutting bit of a router has a shank which is held in place on the shaft by appropriate holding mechanism, including an adjustable, generally hexagonal, set screw. In some routers, the cutting bit may be moved in small increments parallel to the motor shaft, toward or away from the motor, by a fine adjustment mechanism. However, standard routers are all designed so the bit extends below the router base, as standard routers are all designed to smooth edges or drill holes in the workpiece. Standard routers may have "sub-bases," "spacing blocks," or "sub-base plates," which may be attached to the underside surface of a router base to facilitate specific router applications, none of which accomplish the functions of the present invention so far as this inventor is aware.

Other routers are "offset." That is, the axis of rotation of the motor and attached shaft is parallel to, but displaced from, the axis of rotation of the collet and shaft which supports the router bit or cutting head. In offset routers, the router bit generally extends through an opening in the router base which is offset from the axis of the motor and shaft. Such a configuration allows a user to view the bit, and the area of the workpiece around the bit, as the user operates the router. This ability to view the cutting bit, available only when the cutting bit is offset (or placed before or in front of the router), is important for the present invention, as only by placing the cutter in front of the router can a user in the present invention flush cut to the same surface upon which the router is sitting. As more fully explained below, the ability to view the cutting operation, when incorporated into the present invention, allows a user to mill uneven surfaces in front of the router, in the path of the router. Using the present invention, the same surface upon which the router sub-base sits acts as a guide as the cutting bit approaches and then cuts through an irregularity on that surface.

No apparatus or method for working a wooden surface in the related art of which the inventor is aware, including all routers known in the related art, specifically address the difficulty and uneven results inherent in smoothing a wooden surface having a projecting plug or other irregularity, and no apparatus or method allows a user to form a custom threshold or door jam, or other similar custom piece using only a simple, commonly found, powered hand tool and at least one flat surface as a guide. In attempting to achieve smooth surfaces in wood, and form custom pieces, others have created various cutting, smoothing, planing, and forming apparatus, and methods associated therewith. Such apparatus and methods within the related art include:

U.S. Pat. No. 1,574,740 to Raynor, which discloses a cutting device for smoothing a surface.

U.S. Pat. No. 4,132,254 to Shockovsky, which discloses portable planing machine, with runners as guides, for use with a power cutter.

U.S. Pat. No. 4,324,514 to Craven, which discloses an apparatus for guiding a small router head, for cutting sheet metal printing plates to desired outlines.

U.S. Pat. No. 4,529,343 to Adams, which discloses an apparatus for making a custom edge using a router and guide.

U.S. Pat. No. 4,551,047 to Price, which discloses a router having a rotatable cutter for paint removal and other smoothing operations.

U.S. Pat. No. 4,718,468 to Cowman, which discloses a router guide comprising a base plate, for securing to the underside of the router, and a guide coupled to the base plate.

U.S. Pat. No. 5,013,196 to Friegang, which discloses a scribing accessory for an offset router, for trimming a counter top.

U.S. Pat. No. 5,048,580 to Smith, which discloses an attachable workpiece guide for a portable power router, and a planar router base.

U.S. Pat. No. 5,445,198 to McCurry; which discloses a router sub-base with edge-guide.

U.S. Pat. No. 5,452,721 to Engler, III, et al., which discloses a router base-plate for accomplishing a variety of woodworking tasks.

U.S. Pat. No. 5,685,675 to Beekman, which discloses an offset router guide assembly for guiding the movement of a router around an outer edge.

U.S. Pat. No. 6,068,036 to Cassidy, which discloses a large panel surface planer.

U.S. Pat. No. 6,145,556 to Wood, which discloses a router guide comprising a base plate for cutting groove of varying widths.

U.S. Pat. No. 6,148,880 to Dehde et. al., which discloses a planer-type face milling machine, with disk-shaped cutting head running parallel to the workpiece surface.

While the inventions disclosed in these related patents fulfill their respective objectives, these prior patents do not describe or suggest an apparatus or method for working a wooden surface to remove a projecting wooden plug, or any other irregularity using a router, nor does anything in related art describe or suggest an apparatus or method which allows a user to form a custom threshold or door jam, or other similar custom piece using only a simple, commonly found, powered hand tool, such as a router. Nothing in the prior art describes or suggests using any powered hand tool to smooth a surface of irregularities using the existing flat surface as a guide, or remove material using such surface as a guide to produce a custom piece which cannot otherwise be formed using a simple powered hand tool. Nothing in the prior art describes or suggest accomplishing any of these tasks using a powered hand tool "free hand," i.e., without a guide other than the surface upon which the hand tool sits.

The present invention overcomes the drawbacks of prior inventions. A router is used for its small size and versatility. The router is "offset," so that a user may see the workpiece, and wood shavings are easily removed. The offset router (versus the conventional router) also has the distinct advantage of cutting outside the area occupied by the base when the router is in use, thereby allowing the user to cut away material at the margin of a flat surface, or trim wooden plugs from an otherwise smooth surface, using that same flat surface as a guide. This is accomplished by placing the cutting bit in "front" of the router (in front of the router sub-base, really), in the best position to see the work, and the only position from which a user may flush cut to the same surface upon which the router is sitting. By utilizing these features, and other features set forth below, one can, with the offset router base addition, or "sub-base," of the present invention, conveniently trim irregularities on the surface of a wooden workpiece and, with the same sub-base, remove material from a wooden workpiece to create a non-standard threshold, or other custom piece.

DISCLOSURE OF INVENTION

Summary of the Invention

In its simplest form, this invention is a router sub-base, essentially a pad of material of known and established thickness attached to the bottom side of a pre-existing base of an offset router. This pad of material may be known as a "sub-base," a "spacing block," or a "sub-base plate," but in this application we shall generally refer to this material, and this invention when formed into embodiments of the present invention, as the "sub-base." In describing the sub-base in this application, we shall generally describe its dimensions when it is properly positioned on an offset router, and that router is sitting on a flat surface with its base down. The sub-base is of uniform thickness, with substantially vertical sides at the edges of the sub-base. The sub-base is also flat and smooth along its top side, planar face, for attachment to the base of the router, and flat and smooth along its bottom side, planar face, so that it may slide easily over the surface of the workpiece.

The sub-base may be of almost any size horizontally, however a convenient size for most sub-bases is large enough to cover the entire lower surface of the offset router to which the sub-base is fastened, except the area of the router base at and near the collet and shaft which supports the router bit. This size is most convenient because the sub-base in this configuration does not extend beyond the router base, to thereby make the router more unwieldy. On the other hand the sub-base should generally extend to the edge of the router base to gain the full mechanical advantage associated with a larger area when using the router on a flat surface, a process which will be explained more fully below. Of course, in any single application, a sub-base larger than the router base may be advantageous for the greater stability such a sub-base provides on a flat surface, and a sub-base smaller than the router base may be advantageous for the ability such a sub-base may provide to fit into tighter spaces. The sub-base may be of almost any shape so long as the top side face and the bottom side face are substantially parallel (and planar). Thus, the vertical edges may be discrete, individual sides, or the vertical edges may bend into a single "edge" which circumvents the entire sub-base (much as the edge of a coin circumvents the entire coin). However, a generally optimum shape is the same shape as the router base to which the sub-base is attached. All such modifications to sub-bases intended for use on offset routers are encompassed within the present invention.

As noted above, the sub-base of the present invention, when attached to the router base, does not extend into the area under the router base near the collet and router bit. Instead a clearance is provided between the sub-base and the router bit to allow the router bit to rotate as it is intended to rotate when the router is in operation and cutting. The clearance between the sub-base and router bit is also sufficient to allow wood shavings and dust to easily clear the bit as it rotates when in operation and cutting. However, the most important benefit derived from the clearance between the bit and the sub-base is that a user may guide the bit across a projection such as a wooden plug, by moving the nose of the router forward toward the plug and over it, or by moving the nose of the router from one side to the other side, without interference from either the sub-base, or the safety guide which is usually supplied at the nose of the router to prevent injury from the bit.

The vertical shape of the edge of the sub-base nearest the router bit may be flat or curved, however a flat, vertical edge facing the router bit has been found to be effective at clearing wood shavings and dust. The distance between that vertical edge and the router bit may vary, and may be quite close, however one-eighth inch appears to be generally adequate for this purpose. As with the overall size of the sub-base, the distance between the vertical edge of the sub-base and the router bit is, in some sense, a compromise between the added stability afforded by a larger sub-base (with vertical edge closer to the bit) on the one hand, and the ease of use more effective clearing of shavings (with vertical edge further from the bit) on the other hand.

Continuing with the shape and size of the sub-base, the sub-base is, in the preferred embodiment of the invention, about ten one-thousandths ($^{10}/_{1,000}$) of an inch thicker than the distance between the underside of the base of the router and the distal end of the router bit. This spacing is generally accomplished by setting the base of the router on a flat surface with its adjustment screw loose, with a feeler gauge under the cutting bit. Such a thickness provides for cutting of projections (such as newly installed plugs) which extend from a flat surface (such as a boat deck, or other workpiece) to a height of about ten one-thousandths of an inch above the level of the flat surface. This is close to an optimal distance for a plug to extend from a boat deck during construction, a small remaining projection being desirable to avoid marring the surface of the deck, and the ease of sanding off the end of a plug extending this distance from the surface of the deck.

It may be appreciated that, since most routers, including offset routers, allow for adjustment of the cutting bit in a direction parallel to the motor and shaft, i.e. vertically when the router base is placed flat on a horizontal surface, the thickness of the sub-base may vary, and may therefore be of any reasonable thickness. However, the sub-base will generally be approximately as thick as the distance from the tip of the router bit to the bottom of the base of the router and, for routers generally available, the thickness of the sub-base will be within a range around such dimension equal to the range of adjustment for the cutting bit of which the router is capable. From the user's perspective, he or she may simply purchase a sub-base with thickness equal to the distance between the underside of the base of the router and the distal end of the router bit when the bit is set to about the midpoint within its range of adjustability. In many application, including removing the tops of standard sized plugs in boat deck building, a sub-base of 0.80 inches thick is preferred. As standard bases are often about 0.20 inches thick, the thickness of the base and sub-base together is often about a combined 1.00 inch thick.

After the sub-base is attached to the router as set forth herein, the user may then adjust the bit so that its distal end is about ten one-thousandths ($^{10}/_{1,000}$) of one inch closer to the lower surface of the router base than the lower surface of the sub-base is to the lower surface of the router base. Put another way, the end of the cutting bit should be "recessed" from the lower surface of the sub-base, such that when the router is fitted with the sub-base, and the lower surface of the sub-base is placed on a flat, horizontal surface, the end of the bit sits vertically above the flat, horizontal surface about $^{10}/_{1,000}$ of one inch. As noted above, this spacing is generally easily accomplished by setting the base of the router on a flat surface with its adjustment screw loose, with a feeler gauge under the cutting bit, or by inserting such a gauge under the cutting bit while the router sits on a flat surface with its adjustment screw loose (or by loosening the adjustment screw).

The sub-base of the present invention may be fabricated from a variety of materials, including wood, steel, aluminum, and plastic, so long as the material is hard enough to resist wear as it slides across a wooden surface when in use. While materials harder than wood may mar such a surface, such materials are generally preferred because a sub-base made from such materials may be used for a longer time than a sub-base made from softer materials, and a the risk of damage to the workpiece is slight when the user has gained proficiency with the router and sub-base.

The sub-base of the present invention may generally be fastened to the base of a standard offset router as it comes from the manufacturer. The bases of most offset routers are fastened to the main body of the router with screws or bolts (generally four in number), which screws or bolts may be removed, and replaced with longer screws or bolts having the same diameter, pitch, and head size and shape. The length of the new replacement screws is approximately the length of the old factory-installed screws, plus the thickness of the sub-base. As the sub-base is supplied with holes oriented to allow insertion of the new replacement screws through the sub-base and into the screw holes of the main body of the router, a user may remove the old factory screws or bolts of the router base, place the sub-base against the bottom surface of the base of the router, insert the new replacement screws or bolts, and drive the new screws into place (or secure the ends of the new bolts with suitable nuts). The sub-base must be formed so as to provide wells or counter sinks in its lower face, to allow the new replacement screws or bolts to recede from the lower face, thereby allowing the lower face to slide across a wooden surface without marring it. Thus, for routers of standard size, having a base of about 0.20 inches thick, the addition of a preferred size sub-base of about 0.80 inches requires extended screws which are about 0.80 inches longer than the screws originally supplied with the router.

The sub-base may also be installed as a replacement of the router base, rather than under the existing router base. Such installation on the router is desirable in the event the user wishes to work in a tight spot, such as very close to a wall. In such case, the safety guard on the nose of most offset routers is then absent, and the router may then be moved closer to walls and into tight corners. In such installation, the router base is removed, rather than retained in place as in the usual installation of the present invention, and a thicker sub-base (in essence, a replacement router base) is installed in its place. The thicker sub-base is thicker by the amount of the router base which is removed, but may in all other respects have the dimensions of the usual sub-base as set forth above. Of course, with an installation of the sub-base without the router base, shorter new replacement screws or bolts is desirable, so that they do not extend above the screw holes of the main body of the router.

It may be noted that use of the sub-base without the original router base is generally not recommended or desirable, except in the special circumstances where the user wishes to work in a tight place or very close to a wall or other object. The router base generally has a "nose" which surrounds the bit, thereby providing a "stop" which keeps the cutting edges of the bit away from objects which should not be cut. Use of the sub-base without the router base increases the risk of inadvertently placing the spinning bit against some object, such as a wall or the hand of the user.

In one preferred embodiment of the present invention, the sub-base is formed with a channel or groove in the lower surface of the sub-base. The channel should be at least as wide as any plug used to secure decking to its supporting under structure (joists), and at least ten one-thousandths ($^{10}/_{1,000}$) of an inch deep. At this depth, the channel is at least as deep as the distance the cutting bit will remain above the surface of such a deck when a router having the sub-base of the present invention is in operation in a preferred mode. Accordingly, the channel allows one to cut off material to a height above the lower surface of the sub-base as it sits on the flat surface of the workpiece (and therefore above the flat surface of the workpiece itself).

The channel should extend entirely across the lower surface of the sub-base, preferably from its "front" edge, nearest the cutting bit, to its back edge, away from the cutting bit. With such a channel, the router with sub-base may travel over any part of any plugs still projecting, or over any other projections remaining, after cutting, without restriction, as the router is moved "forward" (cutting bit leading). This allows an additional direction of movement as the router cuts a plug or other projection, in addition to movement of the router side to side. As noted above, plugs and other projections are preferably cut close to, but not flush with, the flat surface from which they extend, thereby avoiding damage to such surface. Portions of plugs and other projections remaining such a distance above the surface of the deck or other workpiece may be easily removed by sanding, which is usually required to finish the surface in any case. The channel may also be considerably wider and/or deeper than the dimensions set forth above, and in most cases a wider and deeper channel is preferred, better results being achieved when the channel is at least twice as wide as the diameter of any plug being cut, and at least double the $^{10}/_{1,000}$ clearance between router bit and workpiece surface mentioned above.

For the task of removing the tops of boat decking plugs of standard size, a router bit having a diameter of approximately three-fourths of one inch (¾"), extending through hole in the router base of about seven-eighths of one inch (⅞") or thirteen-sixteenths of one inch ($^{13}/_{16}$") is preferred. With such dimensions, sufficient clearance is provided so that the cutting bit never contacts the router base as the bit is adjusted, regardless of the thickness of the sub-base of the present invention. The cutting bit may with such dimension be even retracted into the base if necessary or desirable. Since router bases are typically supplied with holes of less than three-fourths of one inch (¾"), a manufacturer or user must increase the size of the standard router base hole by re-drilling the original router base hole if a user wishes to utilize the present invention for removal of decking plugs in this preferred embodiment. For removing the tops of decking plugs, a sub-base of about 0.80 inches thick is preferred, with a channel depth of 0.125 inches, and width of 0.90 inches. For other tasks, such as milling a threshold, a larger bit is preferred, generally a bit equal to or greater than one inch (1"). Again, for these tasks, re-drilling the original hole in the router base is preferred to avoid contact between the bit and router base (or the inside of the original hole in the router base).

It should be noted that the sub-base of the present invention may be somewhat modified in dimensions to fit a regular, centered-bit, router, and a user using such router may accomplish the removal of plugs, glue and irregularities from flat wooden surfaces. While use of the sub-base of the present invention on standard routers is less convenient, the channel of the sub-base may be widened to allow a user to cut across a plug easily. For other tasks, such as forming a custom threshold from standard wood stock, the sub-base may be modified to support at least some of the base of a standard router. While such a configuration is not optimal, as forming a custom piece cannot be reasonably be accomplished to the standards of professional wood workers in this configuration, all such modifications intended for standard, centered-bit, routers are encompassed within the present invention.

When in use, the apparatus of the present invention allows a user to work with wood using at least two new processes. These processes include: (1) removing the tops of plugs used to fasten decking boards to underlying substrate, or removing other projections on a flat surface such as a deck, and (2) creation of custom, generally oversize, wooden pieces for special applications such as custom thresholds. In addition, milling a small section of an existing piece to remove irregularities and foreign objects (such as glue) is made possible using a standard offset router. The new processes mentioned above may be more specifically described as follows:

1. Removing the tops of plugs—Using the router base of the present invention on an offset router or a regular, centered-bit, router, a user may remove the tops of plugs (and attendant dried glue) which have been used to fasten decking boards to underlying substrate by:
   A. Attaching the sub-base of the present invention to a router using suitable means,
   B. Attaching a suitable cutting bit to the collet of the router,
   C. Setting the router on a flat surface having plugs or other projections,
   D. Adjusting the cutting bit of the router using the adjustments provided on the router so that the distal end of the bit is recessed back from (above when the router is sitting on a horizontal surface) the lower surface of the sub-base about $^{10}/_{1,000}$ on one inch,
   E. Turning on the router,
   F. Moving the router across the flat surface, keeping the bottom of the sub-base against the flat surface, so that the bit of the router moves to and through a plug or other projection, thereby cutting the plug or other projection so that it extends about $^{10}/_{1,000}$ of one inch from the flat surface after cutting, and
   G. Moving the main part of the router over the cut plug or other projection, so that the remainder of the plug or other projection, extending from the flat surface after the plug or projection is cut, moves through the channel formed in the lower surface of the sub-base, or moving the main part of the router from one side to the other, so that the bit of the router moves away from the cut plug.
2. Creation of custom wooden pieces for special applications—Using the router base of the present invention on an offset router, a user may remove material from a piece of wood using a precut or pre-existing flat surface on that piece of wood as a guide by:
   A. Attaching the sub-base of the present invention to an offset router using suitable means, B. Attaching a suitable cutting bit to the collet of the router,
C. Setting the router on a flat surface of a workpiece,
D. Adjusting the cutting bit of the router using the adjustments provided on the router so that the distal end of the bit is approximately equal to the lower surface of the sub-base (for instance, resting on the flat surface),
E. Turning on the router,
F. Moving the router freehand so that the bit moves, side to side and forward (generally in a series of arcs), to and through a portion of the workpiece remaining at or near the edge of the flat surface of the workpiece, using the flat surface as a guide by placing the lower surface of the sub-base on the flat surface as the user moves the router through such series of arcs, thereby removing stock from the workpiece at or near the edge of the flat surface,
G. Repeating the previous step until sufficient material has been removed from the workpiece, at the desired locations, perhaps limited by one or more stops against which the router nosepiece may bear, to fabricate or machine the desired custom piece.

It may be noted that, if a piece of wood has no pre-existing flat surface to use as a guide when creating a custom piece, a wood worker may cut a into a workpiece with a table saw or other standard equipment, so that the cut is formed. One of the flat surfaces created at the sides of such a cut could be formed into a guiding surface, as a flat surface is formed at the side of the cut toward the main body of the workpiece. Such flat surface may then extend in the direction a flat surface would extend if it already existed on the chosen workpiece. That portion of the workpiece remaining on the other side of the cut (the "overhang" remaining on the opposite side of the cut away from the main body), if any, may be removed by cutting away before the present invention is applied to the workpiece.

The more important features of the invention have thus been outlined, rather broadly, so that the detailed description thereof that follows may be better understood, and in order that the present contribution to the art may be better appreciated. Additional features of specific embodiments of the invention will be described below. However, before explaining preferred embodiments of the invention in detail, it may be noted briefly that the present invention substantially departs from pre-existing apparatus and methods of the prior art, and in so doing provides the user with the highly desirable ability to flush cut to the same surface the cutting tool is sitting on, using an existing flat surface as a guide. This facility is enhanced, when the present invention is used with an offset router. When the cutting bit is placed in front of the base in such offset router, a user may cut projections above a surface to any desired height while viewing the cutting process. Using an offset router, a user may also conveniently cut away wood at the edge of any flat surface of a workpiece to create custom pieces, such as threshold, using such flat surfaces of the workpiece as a guide for further cutting.

OBJECTS OF THE INVENTION

A principal object of the present invention is to provide an apparatus for smoothing a wooden surface using a router.

A further principle object of the present invention is to provide an apparatus for cutting off the tops of plugs and other projections, and dried glue associated therewith, when such plugs are used in building decks on boats and buildings, using a router.

A further principal object of the present invention is to provide an apparatus for removing portions of a workpiece, using an existing flat surface on that workpiece as a guide, to create custom pieces, using an offset router.

A further object of the present invention is to provide a method for smoothing a wooden surface using a router.

A further object of the present invention is to provide a method for cutting off the tops of plugs and other projections, and glue associated therewith, when such plugs are used in building decks on boats and buildings, using a router.

A further object of the present invention is to provide a method for removing portions of a workpiece, using an existing flat surface on that workpiece as a guide, to create custom pieces, using an offset router.

BRIEF DESCRIPTION OF DRAWINGS

The accompanying drawings, which are incorporated in and constitute a part of this specification, illustrate one preferred embodiment of the present invention, and such drawings, together with the description set forth herein, serve to explain the principles of the invention.

DETAILED DESCRIPTION OF PREFERRED EMBODIMENTS

Apparatus of the Invention

Figure 1:
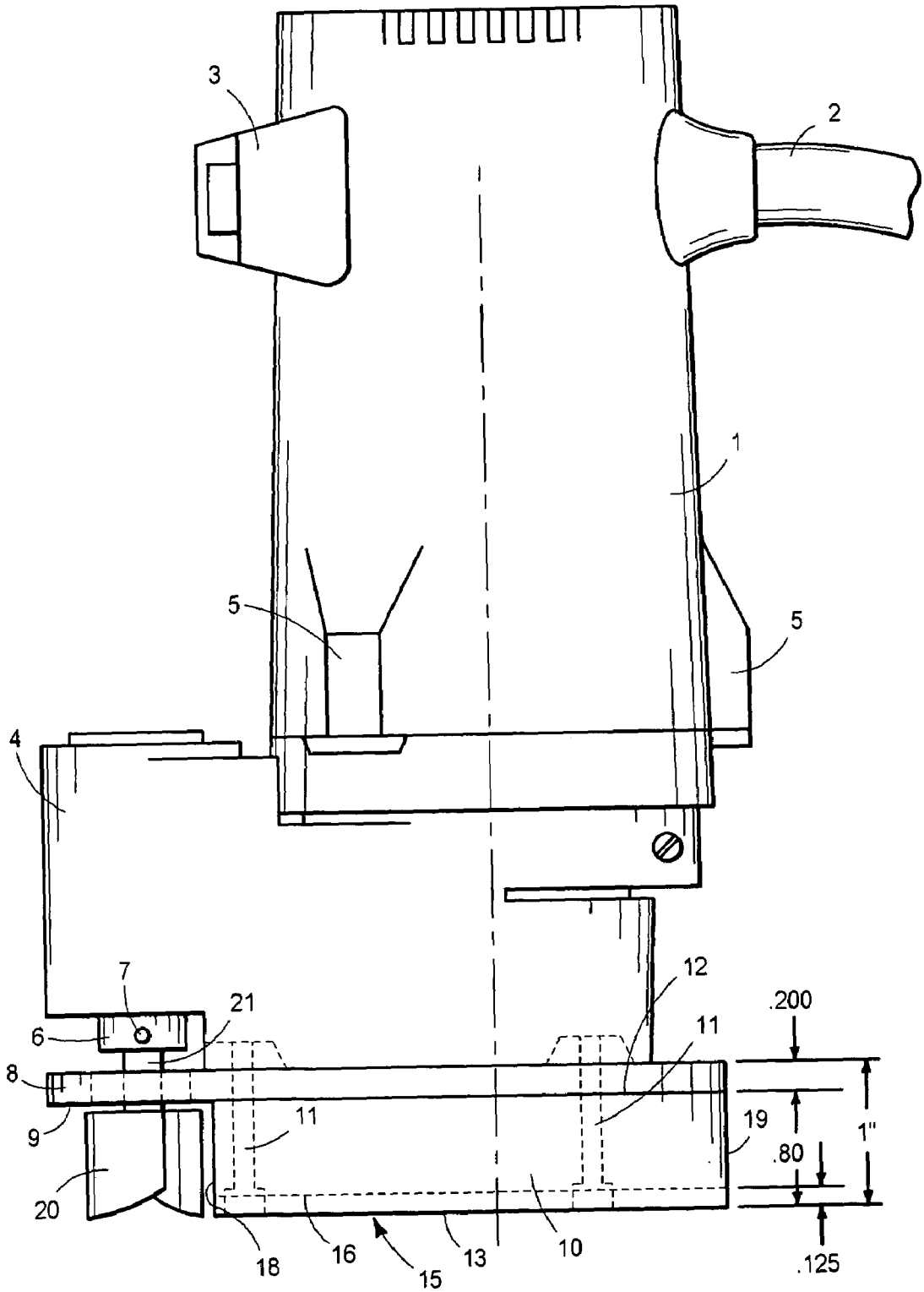
FIG. 1 is a side view drawing of one preferred embodiment of the present invention, showing a router in overall arrangement, its offset attachment, its original base, and the sub-base of the present intention.

Referring initially to FIG. 1, a first embodiment of the present invention is shown in side view. In FIG. 1 a router, with motor housing within which a motor resides, is also equipped with a power cord 2, and switch 3. The router has attached to it an offset attachment 4 using attachment means 5. The offset attachment 4 transmits the rotary motion of the motor to a holding mechanism, such as a collet 6 having an adjustable, generally hexagonal, set screw 7. The offset attachment 4 also has attached to it a base 8, with a lower surface 9, which is employed by a user to guide the router across the top surface of a workpiece (not shown). The base 8 is attached to the offset attachment 4 by holding means (usually screws). In FIG. 1, the sub-base of the present invention 10 is also shown, and the holding means normally used for the base 8 of the router has been replaced with new extended screws 11, which screws are longer than the screws originally supplied with the router. In FIG. 1, the upper face 12 of the sub-base 10 is attached to the router by extended screws 11, and bears against the lower surface 9 of the base 8 of offset attachment 4. The lower face 13 of sub-base 10 has formed in it a channel 15, which extends the length of the sub-base 10, from the front edge 18 of the sub-base 10 to the back edge 19 of the sub-base 10. In this preferred embodiment, the floor 16 of the channel 15 extends fore and aft, 0.125 inches deep, from the front face 18 of the sub-base 10 to the back edge 19 of the sub-base 10, and the channel 15 is 0.90 inches wide. In this preferred embodiments, the sub-base 10 is 0.80 inches thick. As the base 8 is in this embodiment 0.20 inches thick, the thickness of the base 8 and sub-base 10 together is in this embodiment 1.00 inches thick. As a result, the extended screws 11 are in this embodiment 0.80 inches longer than the screws originally supplied with the router to hold the base 8 to the offset attachment 4. Before the router may be used, a cutting bit 20, with shaft 21 is inserted into collet 6. Shaft 21 is then adjusted vertically into the correct position (noted below) in collet 6, and set screw 7 is tightened to secure shaft 21 to collet 6, thereby correctly and securely positioning bit 20 for use.

Figure 2:
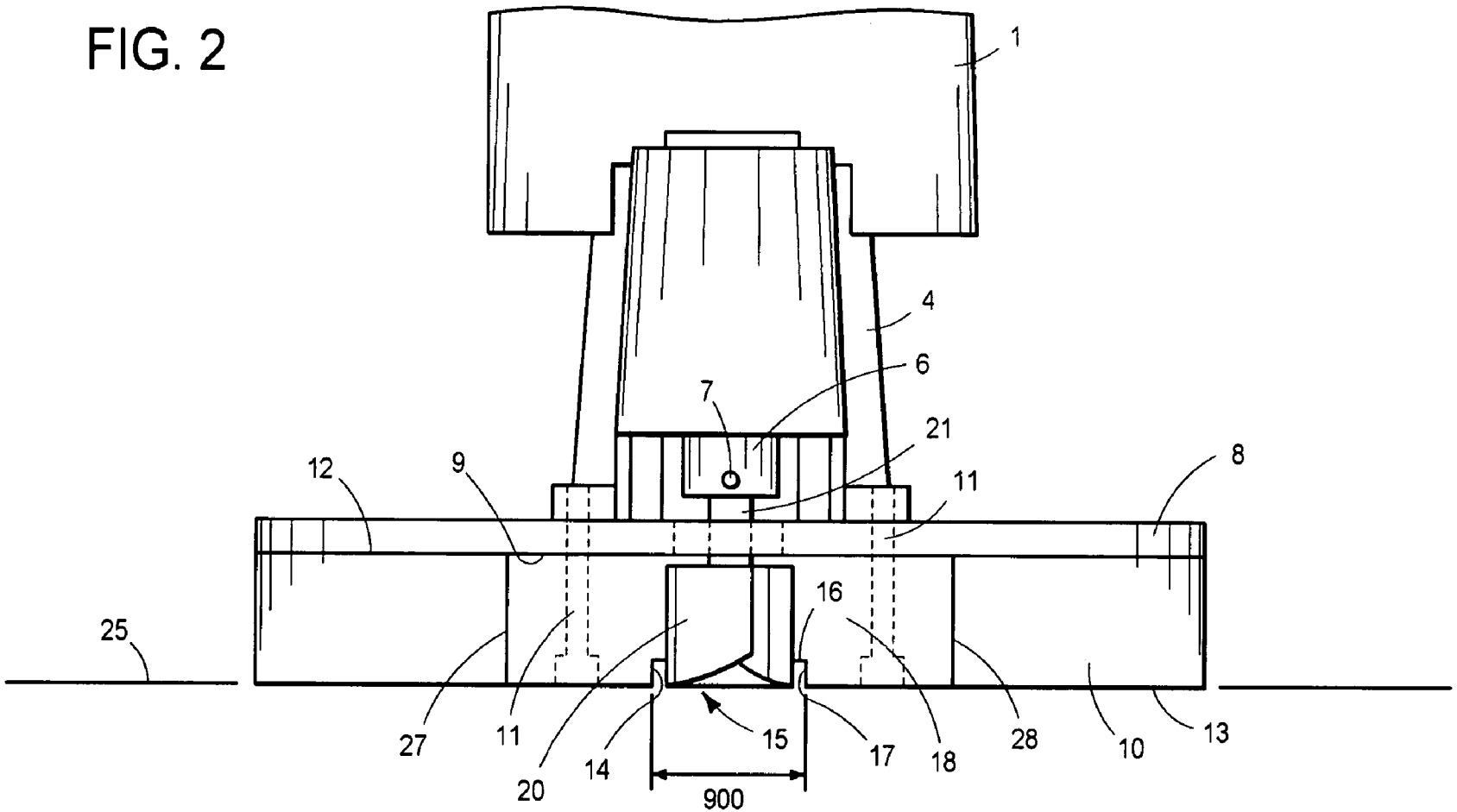
FIG. 2 is a front view drawing of some of the router shown in FIG. 1 (from the side), in which the channel of the sub-base and other details from the front are more apparent.

FIG. 2 is a front view of the apparatus of the present invention, showing motor housing 1, offset attachment 4, with collet 6 and set screw 7. The base 8 of the router, with lower surface 9, is again attached to the offset attachment 4, and again sub-base 10 is shown secured to base 8 with new extended screws 11. Again the upper face 12 of the sub-base 10 is thereby attached to the router by extended screws 11, and bears against the lower surface 9 of the base 8 of offset attachment 4. Again cutting bit 20, with shaft 21 is shown inserted into collet 6, and shaft 21 is adjusted vertically into the correct position in collet 6, and set screw 7 is tightened to secure shaft 21 to collet 6. The correct position for bit 20 is, generally, about ten one-thousandths of one inch ($^{10}/_{1,000}$") above the surface upon which the router sits 25. Accordingly, shaft 21 with attached bit 20 is adjusted in collet 6 (often with fine adjustments) until there appears a clearance of about $^{10}/_{1,000}$ between the bit 20 and such surface 25. This can often be accomplished, with experience, "by eye" when viewing the light between the bit 20 and such surface 25, however a user may also simply insert a gauge of appropriate thickness between the bit 20 and such surface 25 while, at substantially the same time, tightening the set screw 7 in collet 6.

Also appearing in FIG. 2 is channel 15, in this preferred embodiment extending fore and aft, 0.125 inches deep, from the front edge of the sub-base 10 to the back edge of the sub-base 10. The channel is further defined by right channel side 14 and left channel side 17, which are 0.90 inches from each other in this embodiment, thereby providing a channel 15 0.90 inches wide and 0.125 inches deep, front to back along the lower face 13 of sub-base 10. Finally, in FIG. 2 there appears the front face of front edge 18 of the sub-base 10, which is formed in sub-base 10 at the time of manufacture to provide a space between bit 20 and the sub-base 10. Thus, front edge 18 is defined by ridges in the outside edge of sub-base 10, i.e., ridge 27 on the right side of the router, and ridge 28 on the left side of the router. Between ridge 27 and ridge 28, the front edge 18 presents a flat face toward the front of the router and the bit 20.

Figure 3:
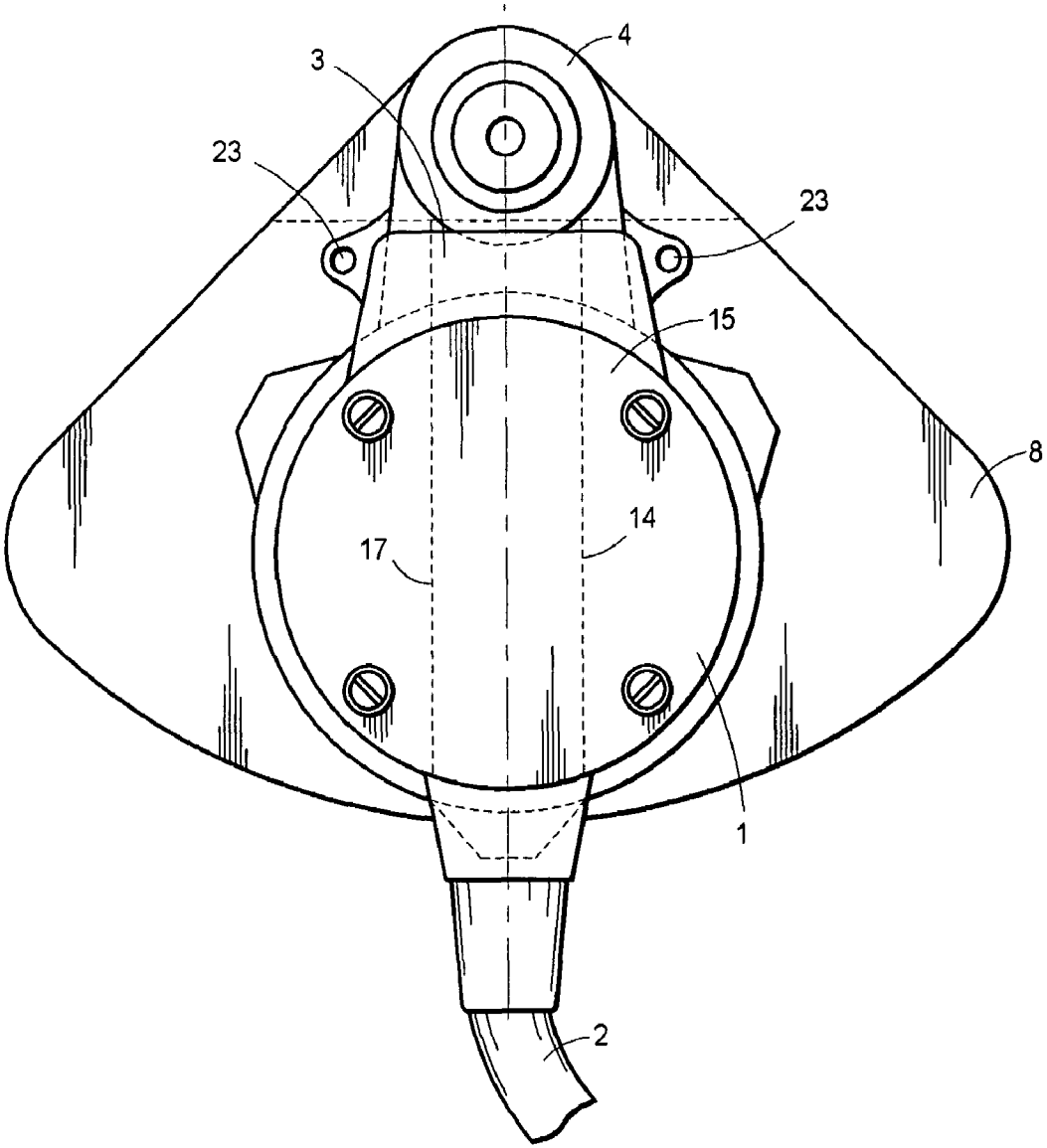
FIG. 3 is top down drawing of the router shown in FIG. 1 and FIG. 2, in which the channel is specifically located.

FIG. 3 is a top down view of the apparatus of the present invention, showing motor housing 1, power cord 2, switch 3, offset attachment 4, and base 8 of the router. FIG. 3 also shows the top of threaded holes into which extended screws 11 are screwed (at 23). Channel 15 is again shown in FIG. 3, however because channel 15 is at the bottom of the router, it is shown by dotted lines which correspond to right channel side 14 and left channel side 17 (which are 0.90 inches from each other in this embodiment, thereby creating a 0.90 inch wide channel).

Other embodiments will be apparent to those skilled in the art from consideration of the specification and practice of the invention disclosed herein. It is intended that the specification and examples be considered as exemplary only, with a true scope of the invention being indicated by the following claims and equivalents.

What is claimed is:

1. A router base comprising:

a first pad of material having a substantially flat and smooth upper surface, a substantially flat and smooth lower surface parallel to the upper surface, and a first pad edge, at the outer margin of said first pad, substantially perpendicular to said first pad upper and lower surfaces, said first pad edge creates a first pad perimeter large enough to cover substantially the entire lower surface of a router, said first pad edge is formed to create an extension of said first pad beyond the lower surface of a router when said first pad is attached to the lower surface of a router, said extension has a hole, extending from the upper surface of said extension to the lower surface of said extension, a second pad of material having a substantially flat and smooth upper face, a substantially flat and smooth lower face parallel to the upper face, and a second pad edge, substantially perpendicular to the second pad upper and lower faces, said second pad edge creates a second pad perimeter, at the outer margin of said second pad, large enough to cover substantially the entire lower surface of said first pad except said lower surface of said extension of said first pad, and screw means for attaching said first pad and said second pad to the lower surface of a router.

2. The router base of claim 1, further comprising a channel formed in the lower face of the second pad.

3. The router base of claim 1, in which said first and second pads are sufficiently thick to position a distal end of a router bit, secured in a router collet of a router, to be positioned approximately ten one-thousandths of an inch from a flat surface when said first and second pads are secured to a router using said screw means, and said first and second pads are placed on a flat surface.

4. The router base of claim 1, in which said first and second pads are together approximately one inch thick.

* * * * *